US011188024B2

(12) United States Patent
Yoshimoto

(10) Patent No.: US 11,188,024 B2
(45) Date of Patent: Nov. 30, 2021

(54) IMAGE FORMING APPARATUS TO WHICH CONTAINER CONTAINING DEVELOPER IS DETACHABLY ATTACHED

(71) Applicant: CANON KABUSHIKI KAISHA, Tokyo (JP)

(72) Inventor: Tetsuhiro Yoshimoto, Tokyo (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/934,763

(22) Filed: Jul. 21, 2020

(65) Prior Publication Data

US 2021/0063959 A1 Mar. 4, 2021

(30) Foreign Application Priority Data

Aug. 26, 2019 (JP) ..... JP2019-153937

(51) Int. Cl.
*G03G 21/18* (2006.01)
*G03G 15/00* (2006.01)
*G03G 15/08* (2006.01)

(52) U.S. Cl.
CPC ..... *G03G 21/1857* (2013.01); *G03G 15/0849* (2013.01); *G03G 15/5012* (2013.01); *G03G 15/55* (2013.01)

(58) Field of Classification Search
CPC ..... G03G 15/5012
See application file for complete search history.

(56) References Cited

U.S. PATENT DOCUMENTS

2012/0048682 A1* 3/2012 Itoh ..... B65G 43/00 198/617

FOREIGN PATENT DOCUMENTS

JP 2005237046 A 9/2005
JP 2016130764 A 7/2016

* cited by examiner

*Primary Examiner* — Victor Verbitsky
(74) *Attorney, Agent, or Firm* — Rossi, Kimms & McDowell LLP

(57) ABSTRACT

An image forming apparatus includes an image forming unit configured to form an image using developer, a mount section on which a container containing the developer is mounted, a drive mechanism that includes a motor that rotates to supply the developer to the image forming unit from the container mounted on the mount section, and a controller configured to obtain an output value related to a load of the motor while rotating the motor without mounting the container on the mount section after the container is detached from the mount section, and detect a failure of the container detached from the mount section based on the output value.

13 Claims, 10 Drawing Sheets

200
24V
FU1
FU2
+24V
210
211
DCDC
+3.3V
212a
CPU
230
+24V_FU
FU3
303a
VOLTAGE DETECTOR
303b
VOLTAGE DETECTOR
231
ASIC
305
SIGNAL DETECTOR
306a
CURRENT DETECTOR
233
MOTOR DRIVER
70
71
72
M

| | POWER SOURCE SECTION | SIGNAL OUTPUT SECTION | CONTROL CIRCUIT SECTION | LOAD OPERATION SECTION |
|---|---|---|---|---|
| MOTOR ROTATION ABNORMALITY | +24V_FU | MOTOR CONTROLLER | MOTOR DRIVER | BOTTLE DRIVE MOTOR |

IMAGE FORMING APPARATUS TO WHICH CONTAINER CONTAINING DEVELOPER IS DETACHABLY ATTACHED

BACKGROUND OF THE INVENTION

Field of the Invention

The present invention relates to failure detection of an image forming apparatus to which a container containing developer is detachably attached.

Description of the Related Art

An image forming apparatus, such as a copying machine or a printer, forms an image on a sheet by cooperated operations of a plurality of components. An operation of each component is controlled separately. When operation control has not completed normally, an image forming apparatus notifies of occurrence of an abnormality by displaying an error code or by transmitting a notification to a call center through a network. When repairing an image forming apparatus on the basis of an error code, a service person specifies a failed place by successively checking presence of failure of components relevant to the error code on a site. This may take a lot of time.

Japanese Laid-Open Patent Publication (Kokai) No. 2005-237046 (JP 2005-237046A) discloses a method for specifying whether a failed place is a high voltage power supply or a load like an electrification wire etc. Moreover, a toner supply unit shown in Japanese Laid-Open Patent Publication (Kokai) No. 2016-130764 (JP 2016-130764A) may be specified as a failed place in an image forming apparatus. The toner supply unit supplies toner from a container by rotating the container that is filled up with the toner (developer). The toner supply unit is configured so that a motor that rotationally drives the container is a drive mechanism and the container is a driven unit.

However, the conventional method for specifying a failed place may be insufficient when a failed place is determined in detail. For example, in a configuration where a motor drives a container through a transfer mechanism, when the container does not rotate even though a motor is instructed to actuate, it cannot distinguish whether the failure is caused from a drive mechanism or the container. That is, there is a problem that it cannot specify whether the failed place is the drive mechanism or the container when the drive mechanism and the container are estimated to be failed places.

SUMMARY OF THE INVENTION

Accordingly, a first aspect of the present invention provides an image forming apparatus including an image forming unit configured to form an image using developer, a mount section on which a container containing the developer is mounted, a drive mechanism that includes a motor that rotates to supply the developer to the image forming unit from the container mounted on the mount section, and a controller configured to obtain an output value related to a load of the motor while rotating the motor without mounting the container on the mount section after the container is detached from the mount section, and detect a failure of the container detached from the mount section based on the output value.

Accordingly, a second aspect of the present invention provides an image forming apparatus including an image forming unit configured to form an image using developer, a mount section on which a container containing the developer is mounted, a drive mechanism that includes a motor that rotates to supply the developer to the image forming unit from the container mounted on the mount section, and a controller configured to obtain an output value related to a load of the motor while rotating the motor without mounting the container on the mount section, and detect a failure of the drive mechanism based on the output value.

Further features of the present invention will become apparent from the following description of exemplary embodiments with reference to the attached drawings.

DESCRIPTION OF THE EMBODIMENTS

Figure 1:
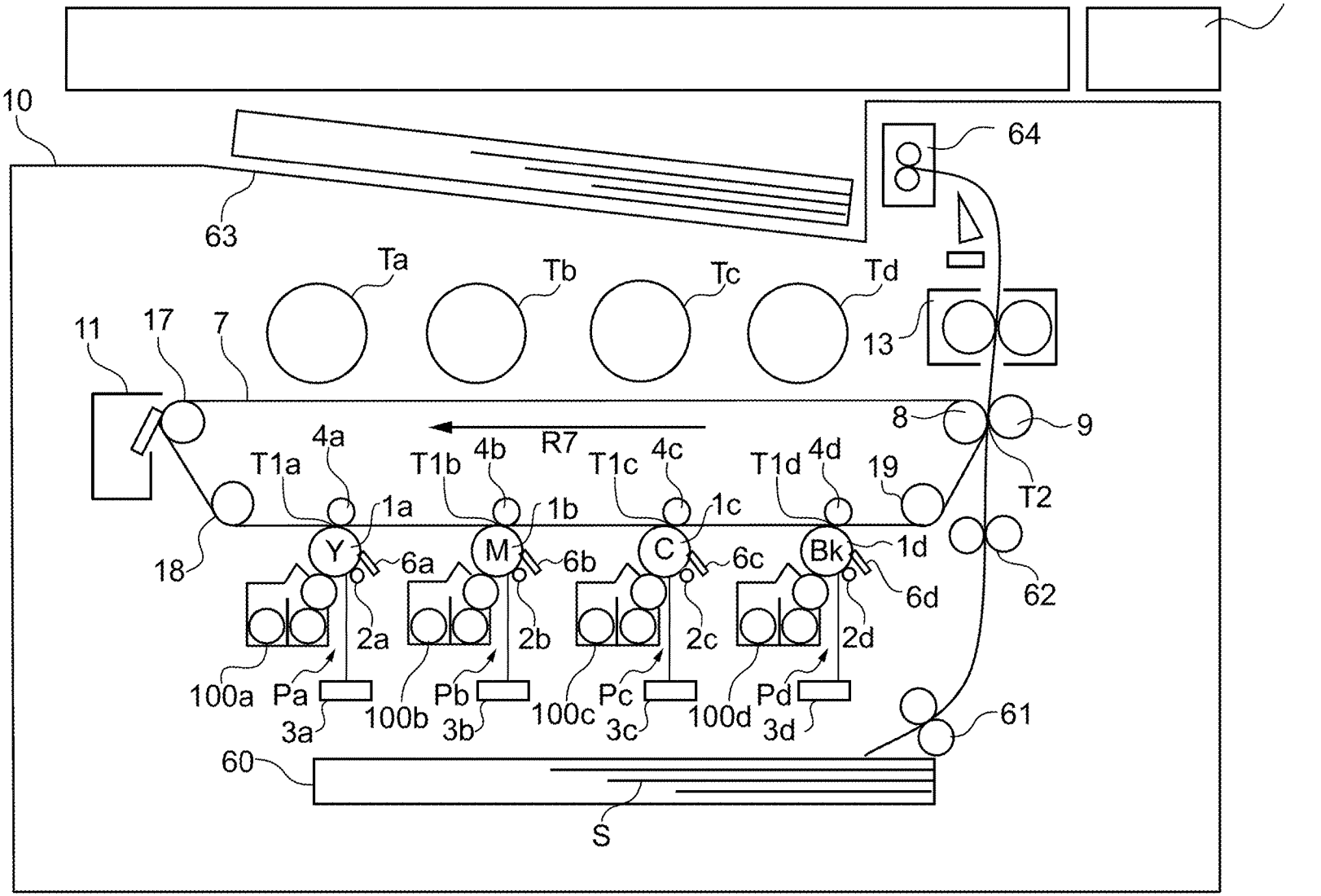
FIG. 1 is a sectional view schematically showing an image forming apparatus of a first embodiment of the present invention.

Hereafter, embodiments according to the present invention will be described in detail by referring to the drawings.

FIG. 1 is a sectional view schematically showing an image forming apparatus of a first embodiment of the present invention. This image forming apparatus 10 is a color image forming apparatus using an electrophotographic system, for example. Particularly, the image forming apparatus 10 employs an intermediate transfer tandem system in which image forming units Pa through Pd are arranged in order along an intermediate transfer belt 7. The image forming units Pa, Pb, Pc, and Pd correspond to 4 colors of yellow (Y), magenta (M), cyan (C), and black (Bk), respectively. The number of colors is not limited to four and the arrangement order is not limited to the above order. Various kinds of control processes described below are performed by a controller 210 (see FIG. 3).

Sheets S that are recording materials are stored and stacked in a sheet cassette 60. A feed roller 61 that employs a frictional separation method feeds a sheet S in accordance with an image formation timing. The sheet S sent out with the feed roller 61 passes a conveyance path and is conveyed to a registration roller pair 62. After the registration roller pair 62 applies skew correction and timing correction to the sheet S, the sheet S is sent to a secondary transfer position T2. The secondary transfer position T2 is a transfer nip position formed between an inner roller 8 and an outer roller 9 that face to each other. A toner image on the intermediate transfer belt 7 is adsorbed to the sheet S at the secondary transfer position T2 by giving predetermined pressure and electrostatic load bias.

An image forming process of which timing is matched to the above-mentioned conveyance process of the sheet S to the secondary transfer position T2 will be described. The image forming units Pa though Pd respectively have photosensitive members 1*a* through 1*d*, charging devices 2*a* through 2*d*, exposure devices 3*a* through 3*d*, development devices 100*a* through 100*d*, transfer devices 4*a* through 4*d*, photosensitive member cleaners 6*a* through 6*d*, etc. The photosensitive members 1*a* through 1*d* are rotationally driven. The charging devices 2*a* through 2*d* uniformly electrify the surfaces of the photosensitive members 1*a* through 1*d*. The exposure devices 3*a* through 3*d* form electrostatic latent images on the photosensitive members 1*a* through 1*d* via diffraction means suitably according to transmitted image information signals.

The development devices 100*a* through 100*d* reveal the electrostatic latent images formed on the photosensitive members 1*a* through 1*d* as toner images. The transfer devices 4*a* through 4*d* transfer the toner images on the photosensitive members 1*a* through 1*d* at primarily transfer nip positions T1*a* through T1*d* to the intermediate transfer belt 7 by applying predetermined pressure and electrostatic load bias. Transfer residual toners that remained slightly on the photosensitive members 1*a* through 1*d* are collected by the photosensitive member cleaners 6*a* through 6*d* and are used for the following image forming process.

Each of the development devices 100*a* through 100*d* contains two-component developer that is made by mixing non-magnetic toner and magnetic carrier beforehand. It should be noted that the development devices 100*a* through 100*d* may contain one-component developer that is made by magnetic toner or non-magnetic toner.

The intermediate transfer belt 7 is installed in an intermediate transfer belt frame (not shown). The intermediate transfer belt 7 is an endless belt that is looped by the inner roller 8, a tension roller 17, and an upper roller 18, and is rotated in a direction of an arrow R7. The inner roller 8 also has a drive transfer function for the intermediate transfer belt 7. The image forming processes of the respective colors that are parallelly processed by the image forming units Pb through Pd are performed at predetermined timings so that toner images pail on a yellow toner image that is primarily transferred onto the intermediate transfer belt 7. As a result, a full color toner image is formed on the intermediate transfer belt 7 finally and is conveyed to the secondary transfer position T2. It should be noted that transfer residual toner after passing the secondary transfer position T2 is collected by a transfer cleaning device 11.

The timing of the full color toner image matches the timing of the sheet S at the secondary transfer position T2 by the above-mentioned conveyance process and the image forming process. After that, the sheet S is conveyed to the fixing device 13. The fixing device 13 melts the toner image on the intermediate transfer belt 7 and fixes it onto the sheet S within a fixing nip formed by two rollers that face to each other by giving predetermined pressure and heat to the sheet S that passes. Accordingly, the fixing device 13 is provided with a heater as a heat source and is controlled so that the optimal temperature is always maintained. The sheet S to which the image is fixed is discharged on a discharge tray 63 by an ejection roller pair 64.

Figure 2A:
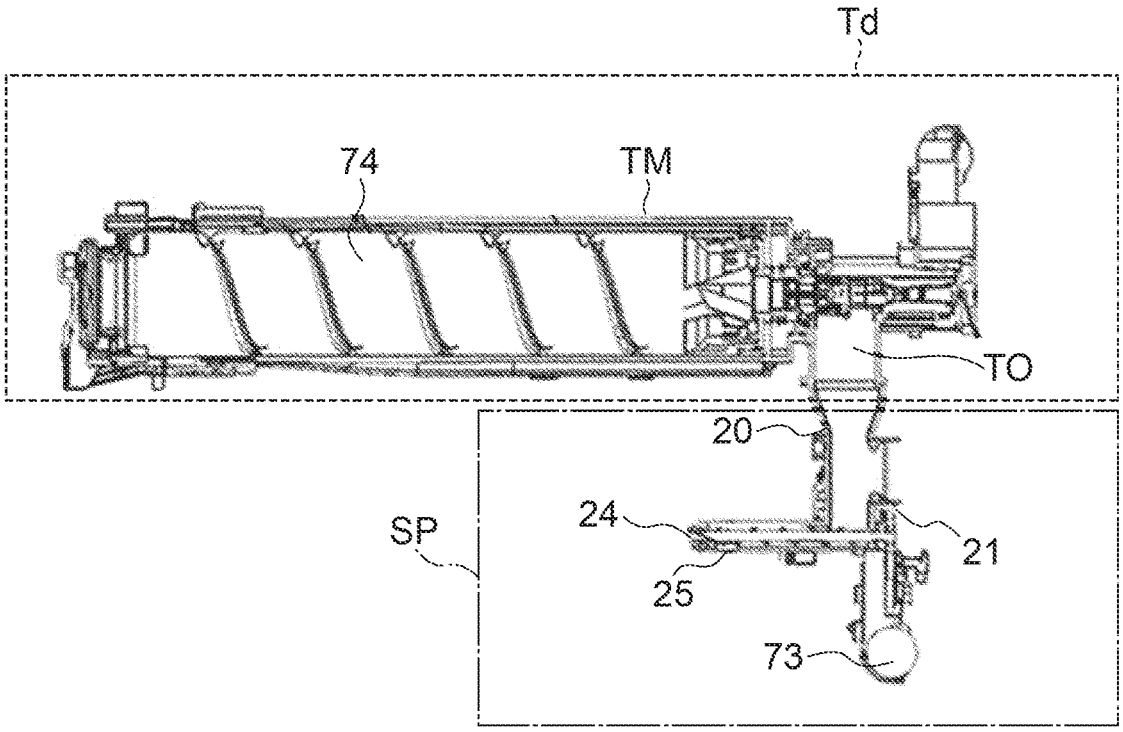
FIG. 2A is a sectional view showing a chamber and a toner supply unit of the image forming apparatus of FIG. 1.

Chambers Ta, Tb, Tc, and Td are provided corresponding to the development devices 100*a*, 100*b*, 100*c*, and 100*d*. Moreover, a toner supply unit SP (FIG. 2A) is provided corresponding to each of the chambers Ta, T, Tc, and Td. When the toner remaining amount in the development device 100*a*, 100*b*, 100*c*, or 100*d* becomes equal to or less than a second predetermined amount, the toner is supplied from the corresponding chamber Ta, Tb, Tc, or Td via the corresponding toner supply unit SP (FIG. 2A). It should be noted that development devices 100*a* through 100*d* are provided with density sensors (not shown). Each of the density sensors detects whether the toner remaining amount in the corresponding development device 100*a*, 100*b*, 100*c*, or 100*d* becomes equal to or less than the second predetermined amount. Furthermore, when a toner remaining amount in a toner supply unit SP becomes equal to or less than a first predetermined amount, toner is supplied to the toner supply unit SP from the corresponding chamber Ta, Tb, Tc, or Td. A remaining amount sensor 21 (FIG. 2A) mentioned later detects whether a toner remaining amount in a toner supply unit SP is lowered below the first predetermined amount.

Figure 2B:
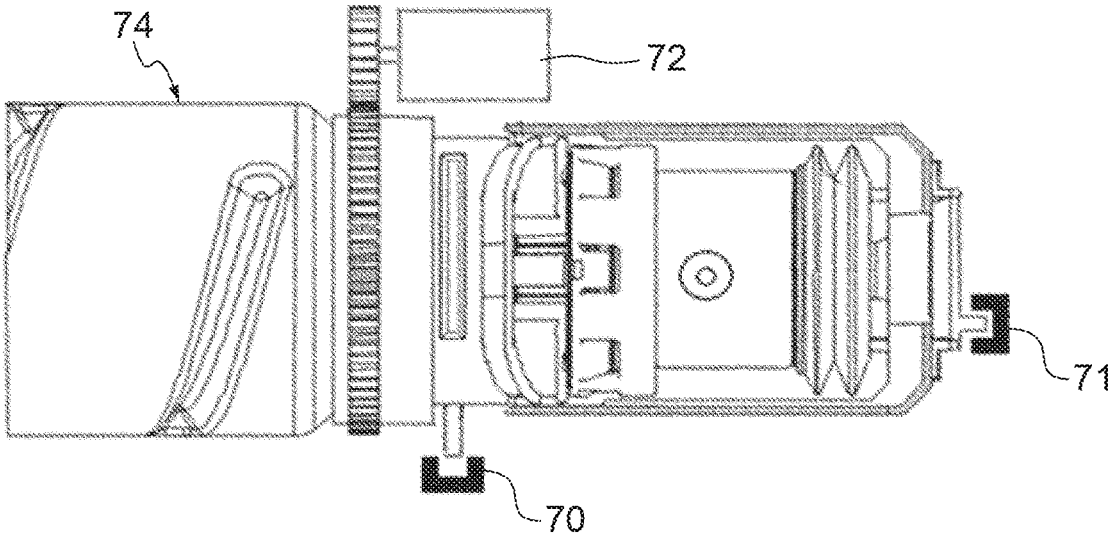
FIG. 2B is a partial sectional view of a container of the image forming apparatus of FIG. 1.

FIG. 2A is a sectional view showing the chamber Td and toner supply unit SP that contain Bk toner. A container 74 that contain developer (hereinafter referred to as toner) of Bk corresponding to the image forming unit Pd is detachably attached to the chamber Td. FIG. 2B is a partial sectional view of the container 74. FIG. 2A and FIG. 2B show the chamber Td of Bk and the corresponding toner supply unit SP as representatives. The chambers Ta, Tb, and Tc of the other three colors and the corresponding toner supply units SP are configured similarly except the colors of the toners contained inside.

A main part of the image forming apparatus is provided with a bottle mount TM as a mount section for every color. The container 74 is attached to the main part of the image forming apparatus because the periphery of the container 74 is supported by the corresponding bottle mount TM. The container 74 is detachable from the bottle mount TM. The container 74 attached is freely rotatable with respect to the bottle mount TM.

A bottle drive motor 72 rotationally drives the container 74. Rotational driving force of the bottle drive motor 72 is transferred to the container 74 through a drive gear engaged with the bottle drive motor 72. When the container 74 rotates, the container 74 conveys the contained toner along a helical structure formed inside the container 4 and supplies the toner to the toner supply unit SP through a communicating port TO. A rotation sensor 70 detects a rotary action of the container 74. The detection result of the rotation sensor 70 indicates whether the container 74 is rotating normally. An attachment sensor 71 is a detector that detects presence or absence of attachment of the container 74 to the bottle mount TM. The detection result of the attachment sensor 71 indicates whether the container 74 is attached to the bottle mount TM.

Next, the toner supply unit SP will be described. The toner supply units SP are respectively arranged between the chambers Ta through Td and the development devices 100*a* through 100*d*. Each of the toner supply units SP has a buffer container 20, the remaining amount sensor 21, a replenishment motor 73, a metering screw 24, and a development replenishment opening 25. The toner that is discharged from the chamber Td and supplied to the toner supply unit SP is stored in the buffer container 20. The buffer container 20 is called a hopper. The remaining amount sensor 21 is installed in the internal side wall of the buffer container 20 and detects the toner remaining amount in the buffer container 20. The bottle drive motor 72 is driven according to the toner remaining amount in the buffer container 20 detected by the remaining amount sensor 21 and the toner is supplied to the toner supply unit SP from the chamber Td.

The toner stored in the buffer container 20 is suitably supplied to the development device 100*d* from the development replenishment opening 25 by the rotation of the metering screw 24 that is driven by the replenishment motor 73. The toner amount that the development device 100*d* needs is supplied. Moreover, when the image forming apparatus 10 is activated first or when the container 74 is replaced because the container 74 becomes empty, an initial filling operation is executed. In the description, the state where the container 74 becomes empty does not necessarily mean that the toner becomes zero. That is, when the state where the toner remaining amount in the development device 100*d* is below the second predetermined amount and where the toner remaining amount in the toner supply unit SP is below the first predetermined amount continues for a definite period of time, it is determined that the container 74 becomes empty.

In the initial filling operation, the toner replenishment operation continues until the buffer container 20 fills up with the toner while the rotation sensor 70 detects the rotation of the container 74 and the remaining amount sensor 21 detects the toner. At the time, the CPU 212*a* (FIG. 3) later mentioned determines that replenishment operation abnormality has occurred when the rotation sensor 70 does not detect the rotation of the container 74 continuously during a predetermined period time_2 (for example, 5 seconds). Furthermore, the CPU 212*a* determines that the replenishment operation abnormality has occurred also when the remaining amount sensor 21 does not detect that the toner remaining amount in the toner supply unit SP exceeds the first predetermined amount continuously during a predetermined period time_1 (for example, 5 minutes).

Figure 3:
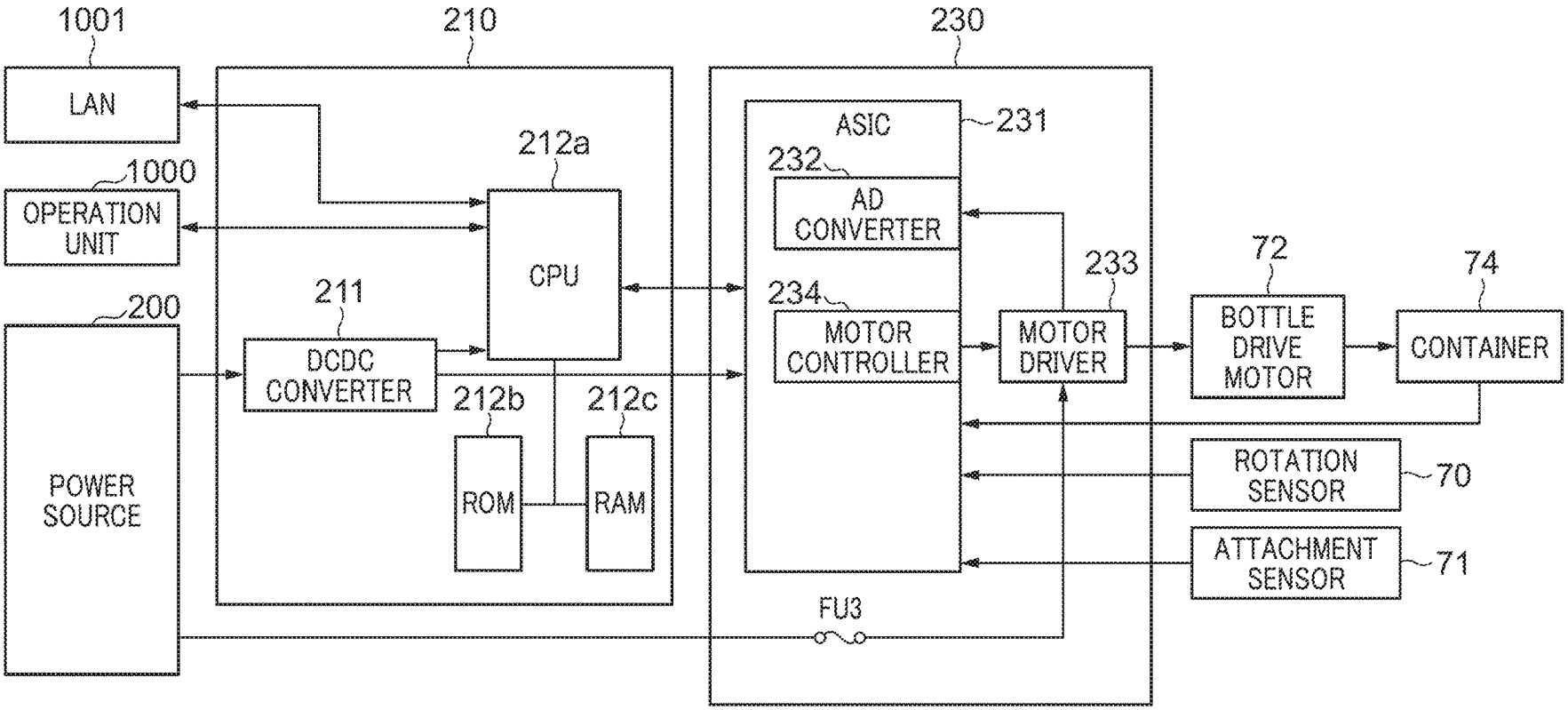
FIG. 3 is a block diagram schematically showing a control system of the image forming apparatus of FIG. 1.
Figure 4:
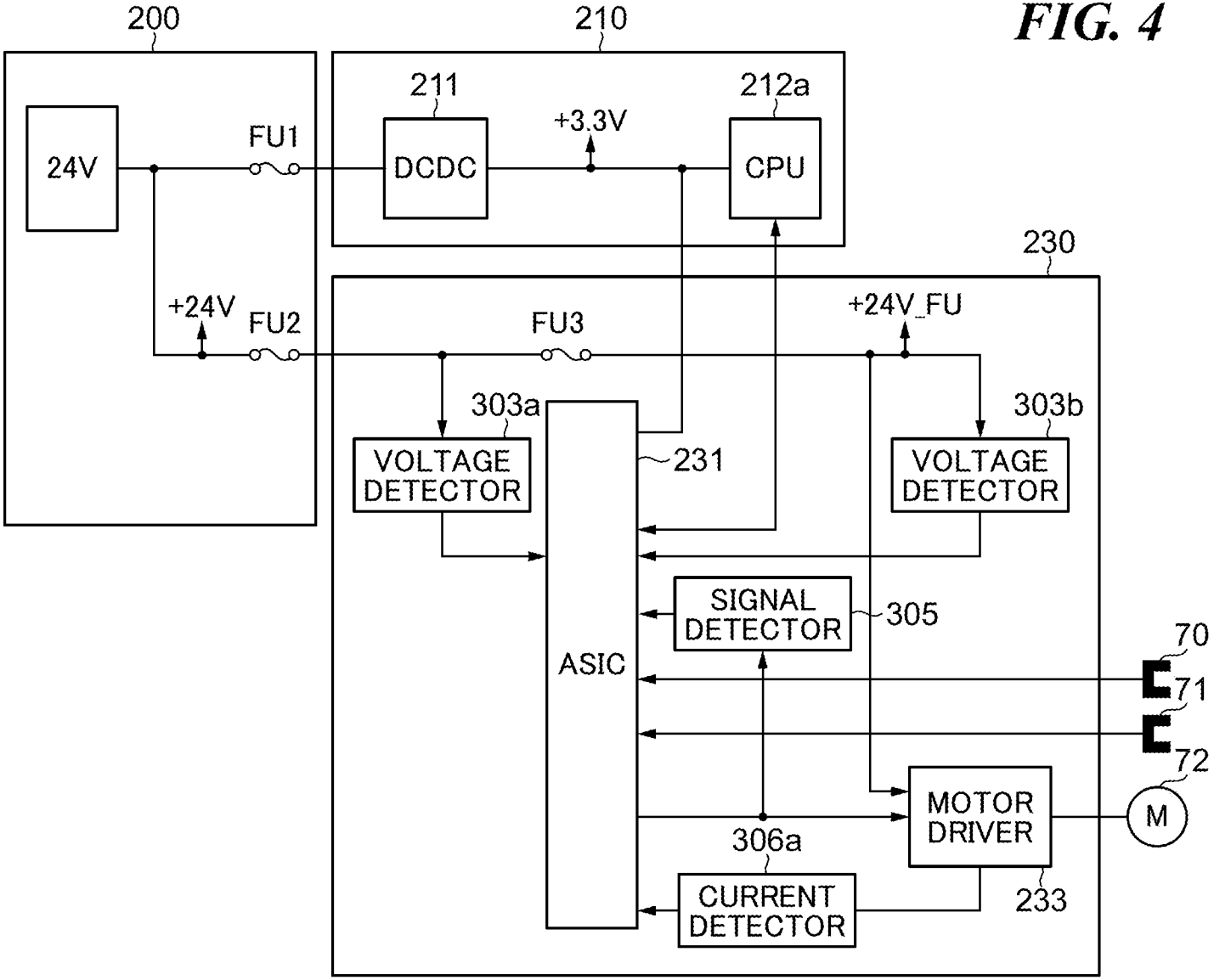
FIG. 4 is a control circuit diagram of the image forming apparatus of FIG. 1.

FIG. 3 is a block diagram schematically showing a control system of the image forming apparatus 10. FIG. 4 is a control circuit diagram of the image forming apparatus 10. The control system in connection with toner supply control will be mainly described by referring to FIG. 3 and FIG. 4. This control system detects attachment and detachment of the container 74 and controls a rotation control function. The control system is provided with a power unit 200, the controller 210, a driver unit 230, and the bottle drive motor 72.

The power unit 200 is provided with fuses FU1 and FU2. The controller 210 is provided with a DCDC converter 211, the CPU 212*a*, a ROM 212*b*, and a RAM 212*c*. The driver unit 230 is provided with an ASIC (Application Specific Integrated Circuit) 231, a motor driver 233, and a fuse FU3. The driver unit 230 controls a rotation of the bottle drive motor 72. Moreover, the driver unit 230 is provided with voltage detectors 303*a* and 303*b*, a signal detector 305, and a current detector 306*a* for failed place specification mentioned later. Such a control system operates as a power source section, control section, signal output section, control circuit section, and load operation section.

The power source section will be described. The power source section mainly includes the power unit 200 and a fuse FU3. The power unit 200 outputs supply voltage of +24V. The power unit 200 distributes power supply voltage through the fuses FU1 and FU2, and supplies electric power to each component. The controller 210 decreases the power supply voltage of +24V supplied from the power unit 200 to voltage of 3.3V with the DCDC converter 211, and supplies it to the CPU 212*a*, the driver unit 230 including the ASIC 231, etc. The driver unit 230 further protects the supply voltage of +24V supplied from the power unit 200 with the fuse FU3 and supplies the electric power to the motor driver 233.

The control section will be described. The control section is mainly achieved by the controller 210. The controller 210 performs various control sequences about image formation because the CPU 212*a* runs a control program stored in the ROM 212*b* and controls operations of components. At the time, the RAM 212*c* is used as a work memory and stores rewritable data. The RAM 212*c* stores information, such as drive setting information about a detachable unit and information about a used toner amount. The CPU 212*a* performs serial communication with the ASIC 231. The CPU 212*a* controls an operation of the ASIC 231 by performing read/write operations by serial communication with a register and RAM inside the ASIC 231.

The signal output section will be described. The signal output section is mainly achieved by the ASIC 231. The ASIC 231 is provided with an AD converter 232 that takes an analog signal value and a motor controller 234 that controls the bottle drive motor 72 as functional modules. The ASIC 231 obtains setting values from the CPU 212*a* and sets up the functional modules on the basis of the respective setting values. Each functional module outputs a control signal because a logic circuit operates according to each setting value. The motor controller 234 outputs motor control signals for controlling an operation of the motor driver 233.

The control circuit section will be described. The control circuit section is mainly configured by the motor driver 233. The control circuit section controls an operation of the load operation section connected on the basis of the power supply voltage supplied from the power source section and the control signal obtained from the signal output section. For example, the motor driver 233 is provided with a driver IC for driving the bottle drive motor 72. The driver IC controls rotation of the bottle drive motor 72 on the basis of the motor control signals that drive the bottle drive motor 72. When the bottle drive motor 72 rotates, the toner is supplied because the container 74 rotates. When the container 74 rotates, the rotation sensor 70 (FIG. 2B) sends the ASIC 231 a detection result indicating that the rotation is detected. Moreover, when the container 74 is attached to the bottle mount TM, the attachment sensor 71 (FIG. 2B) sends the ASIC 231 a detection result indicating that the attachment is detected.

The ASIC 231 transmits the detection results of the rotation sensor 70 and the attachment sensor 71 to the CPU 212*a* as binary signals. The binary signals indicating the detection result of the rotation sensor 70 consist of a signal of 3.3V output when the rotation of the bottle drive motor 72 is detected and a signal of 0V output when the rotation of the bottle drive motor 72 is not detected, for example. The binary signals indicating the detection result of the attachment sensor 71 consists of a signal of 3.3V output when the attachment sensor 71 detects the container 74 and a signal of 0V output when the attachment sensor 71 does not detect the container 74. Moreover, the ASIC 231 converts the output current value of the motor driver 233 into a digital signal with the A/D converter 232 and transmits it to the CPU 212*a*. The CPU 212*a* controls the toner supply from the container 74 on the basis of the obtained detection results. Two rotations of the container 74 are defined as one replenishment operation in the toner supply control. One rotation needs 500 ms on average. Accordingly, one replenishment operation normally completes within about 1 second. The CPU 212*a* determines that an abnormality has occurred in the supply control from the container 74, when one replenishment operation does not complete within the predetermined period time_2 (5 seconds). That is, the CPU 212*a* determines whether the replenishment operation abnormality occurs in the bottle drive motor 72 and the container 74 of the load operation section on the basis of the detection result of the rotation sensor 70. A plurality of sensors that detect such a replenishment operation abnormality are provided corresponding to respective members of the load operation section. When occurrence of the replenishment operation abnormality is determined, the CPU 212*a* stops the image forming operation and executes a failed place specification process (FIG. 10 mentioned later) for determining the failed place that causes the abnormality.

It should be noted that the CPU 212*a* is connected to an operation unit 1000 and a network interface (I/F) 1001 (FIG. 3). The operation unit 1000 includes a liquid crystal display. The operation unit 1000 of this embodiment is a touch panel display unit. The CPU 212*a* obtains an input signal, such as an instruction, from the operation unit 1000 and displays information corresponding to the input signal on the operation unit 1000. The CPU 212*a* communicates with external apparatuses, such as a computer, through the network i/F 1001.

Figures 5A, 5B:
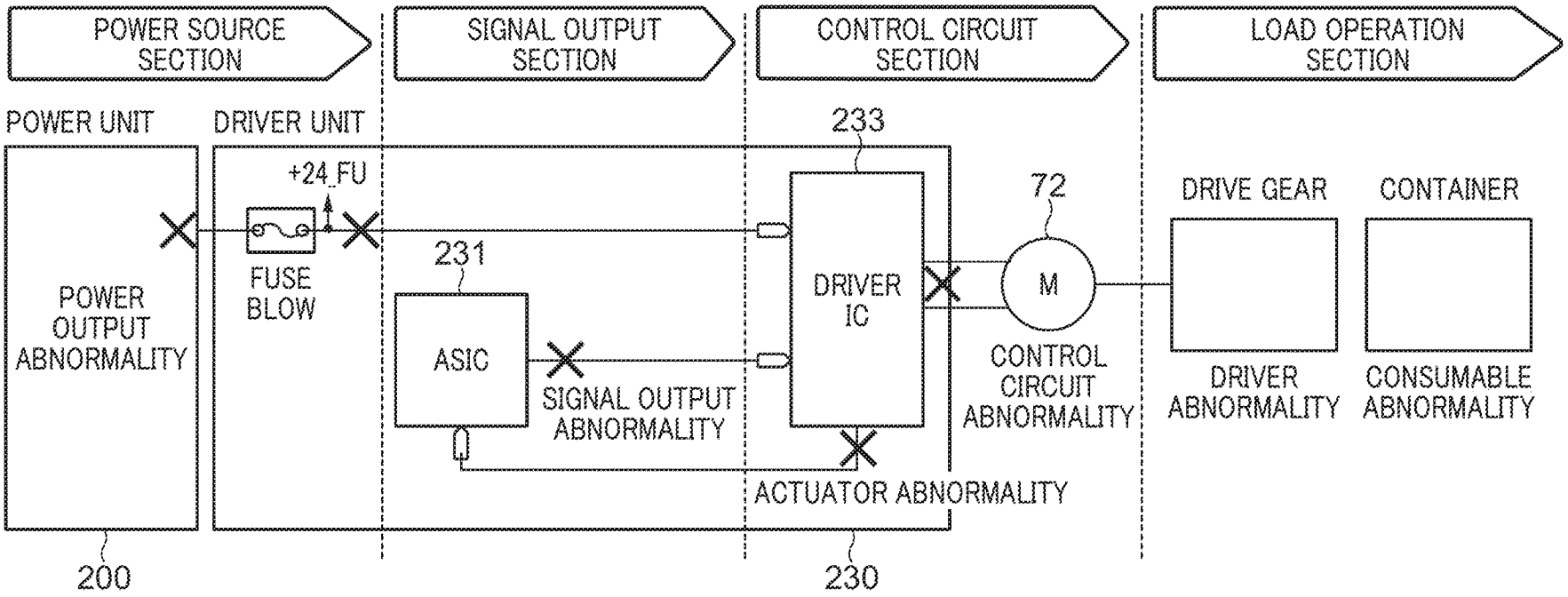
FIG. 5A is a view showing a failed place specification table of the image forming apparatus of FIG. 1.
FIG. 5B is a view showing an example of a failed place in each section of the control system of the image forming apparatus of FIG. 1.

FIG. 5A is a view showing a failed place specification table. FIG. 5B is a view showing an example of a failed place in each section of the control system. The failed place specification table is stored in the RAM 212*c*. The failed place specification table associates failed place specification information with each of the power source section, signal output section, control circuit section, and load operation section that constitute the control system. When a replenishment operation abnormality occurs, the CPU 212*a* specifies a unit having a failed place as a failed unit by referring to the failed place specification information. For example, when it is determined that failure is detected by the failed place specification process about the signal output section, the motor controller 234 is specified as a failed place and the driver unit 230 is specified as a failed unit. The failed place specification process is sequentially performed in order of the power source section, signal output section, control circuit section, and load operation section, for example.

As mentioned above partially, the power source section mainly includes the power unit 200 and the fuse FU3. The signal output section mainly includes the ASIC 231. The control circuit section mainly includes the motor driver 233 and the bottle drive motor 72. The load operation section mainly includes the bottle drive motor 72, drive gear, and container 74. On the concept of the failed place specification process, the bottle drive motor 72*a* is included in both the control circuit section and the load operation section. However, the bottle drive motor 72*a* may be included in only one of them. The power source section (the power unit 200) supplies electric power to the bottle drive motor 72 etc. The signal output section (the motor controller 234) outputs the motor control signals. The control circuit section (the motor driver 233) supplies the electric current based on the motor control signals to the bottle drive motor 72.

Figure 6:
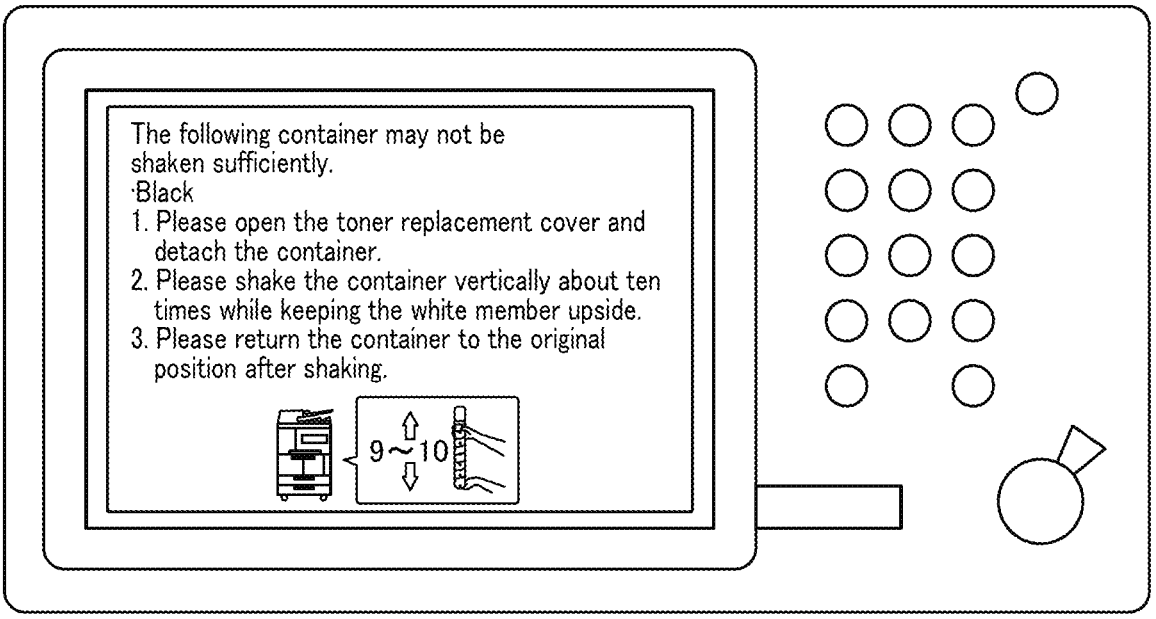
FIG. 6 is a view showing a notification screen example of the image forming apparatus of FIG. 1.
Figure 7A:
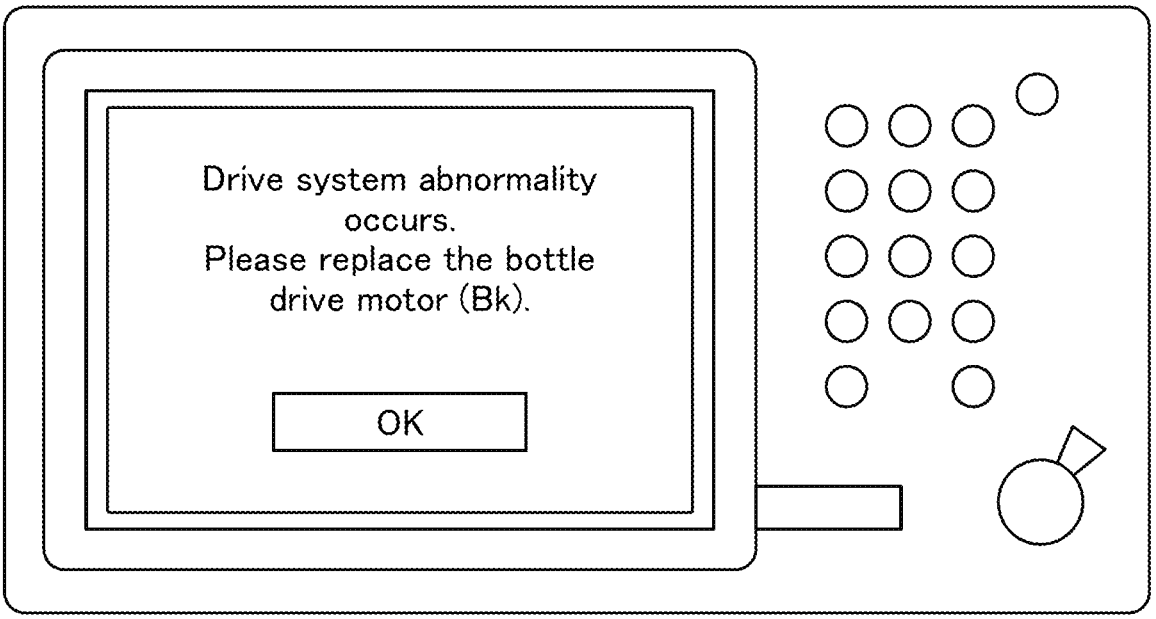
FIG. 7A and FIG. 7B are views showing notification screen examples of the image forming apparatus of FIG. 1.
Figure 7B:
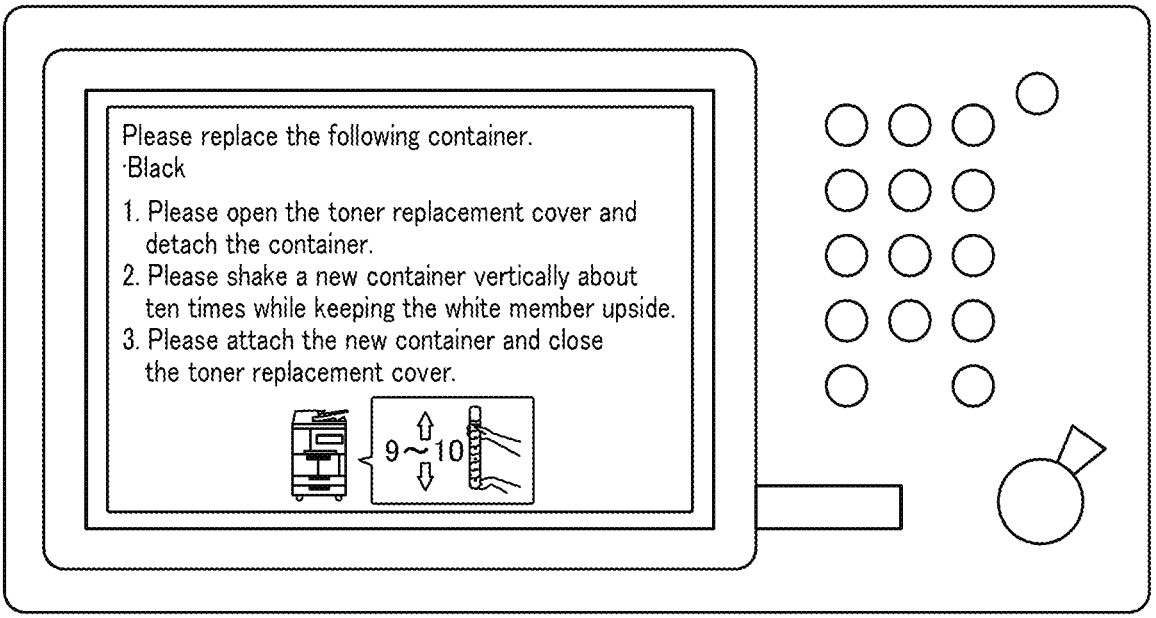

FIG. 6, FIG. 7A, and FIG. 7B are views showing notification screen examples displayed on the operation unit 1000. FIG. 6 shows a notification screen that prompts a user to detach and shake the container 74. This notification screen is displayed when it is determined that the replenishment operation have not finished normally. FIG. 7A shows a notification screen displayed when it is determined that there is an abnormality in a drive mechanism. FIG. 7B shows a notification screen displayed when it is determined that there is an abnormality in the container 74.

Figure 8:
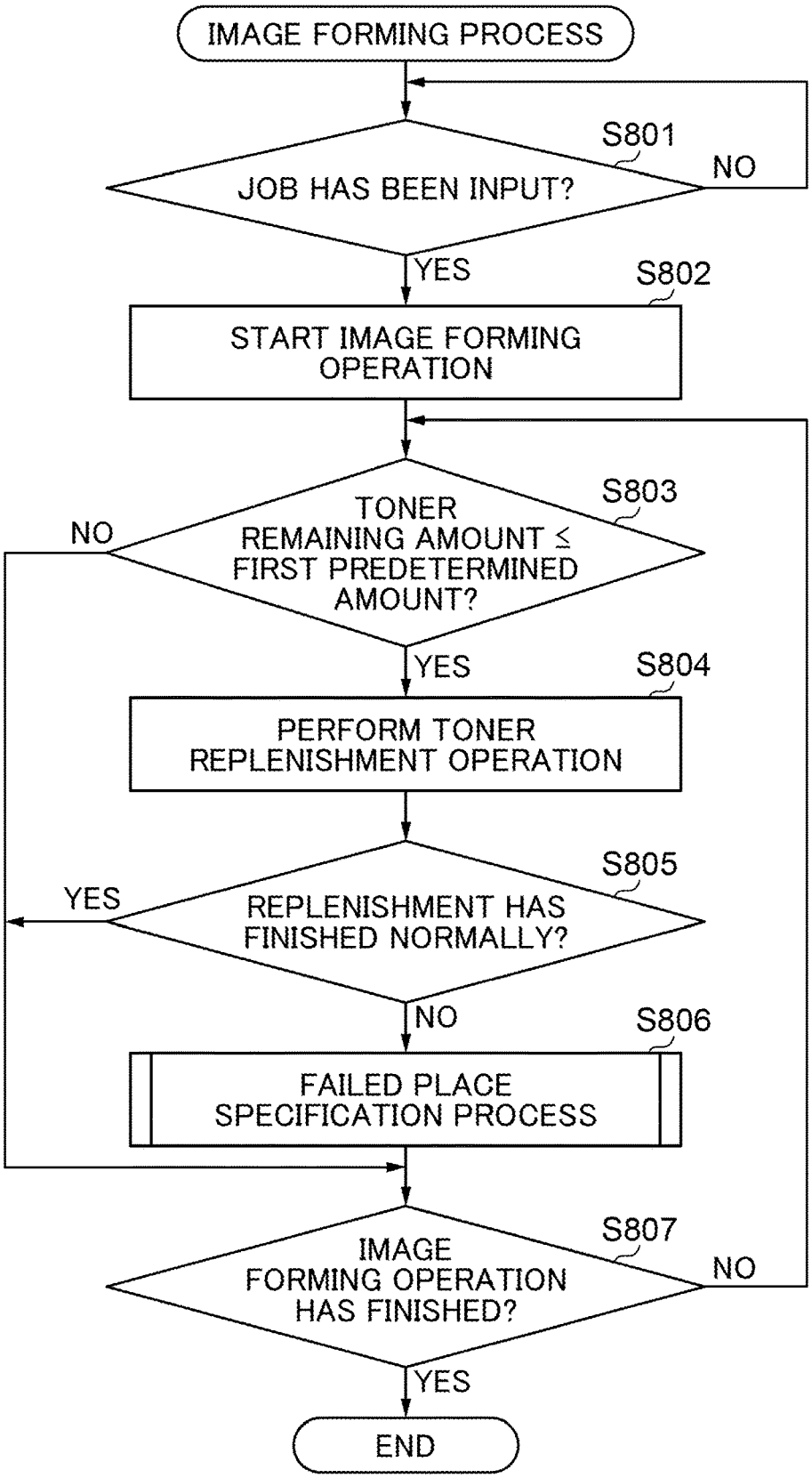
FIG. 8 is a flowchart showing an image forming process in the image forming apparatus of FIG. 1.

FIG. 8 is a flowchart showing an image forming process. This process is achieved when the CPU 121*a* develops a program stored in the ROM 212*b* to the RAM 212*c* and runs it. This processing is executed at certain time intervals after the power of the apparatus is turned ON, for example.

In step S801, the CPU 212*a* determines whether an image forming job has been input. The image forming job is input when an instruction for starting the image formation is received from a user through the operation unit 1000 or through the network I/F 1001. When the image forming job has been input, the CPU 212*a* starts an image forming operation in step S802. It should be noted that the remaining amount sensor 21 always detects the toner remaining amount of the buffer container 20 during the image forming operation. In step S803, the CPU 212*a* determines whether the toner remaining amount of the buffer container 20 becomes equal to or less than the first predetermined amount. This determination is performed for every color.

When the toner remaining amount of the buffer container 20 exceeds the first predetermined amount, the CPU 212*a* proceeds with the process to step S807 because the toner supply from the container 74 is not needed. In the meantime, when the toner remaining amount of the buffer container 20 becomes equal to or less than the first predetermined amount, the CPU 212*a* performs the toner replenishment operation by operating the corresponding bottle drive motor 72 in step S804. Thereby, the container 74 rotates and the toner is supplied to the buffer container 20 from the container 74.

In step S805, the CPU 212*a* determines whether the replenishment operation has finished normally. When determining that one replenishment operation (two rotations) has been completed in the predetermined period time_2 (5 seconds) on the basis of the detection result of the rotation sensor 70, the CPU 212*a* determines that the replenishment operation has finished normally. For example, when one replenishment operation needs the predetermined period time_2 or more, the CPU 212*a* determines that the replenishment operation has not finished normally. Then, when determining that the replenishment operation has finished normally, the CPU 212*a* proceeds with the process to step S807. In the meantime, when determining that the replenishment operation has not finished normally, the CPU 212*a* determines that the replenishment operation abnormality has occurred, executes the failed place specification process (FIG. 10) mentioned later in step S806, and then proceeds with the process to the step S807. In the step S807, the CPU 212*a* determines whether the image forming operation corresponding to the current job has finished. When the image forming operation corresponding to the current job has not finished, the CPU 212*a* returns the process to the step S803. When the image forming operation corresponding to the current job has finished, the CPU 212*a* finishes the image forming process shown in FIG. 8.

Figure 9:
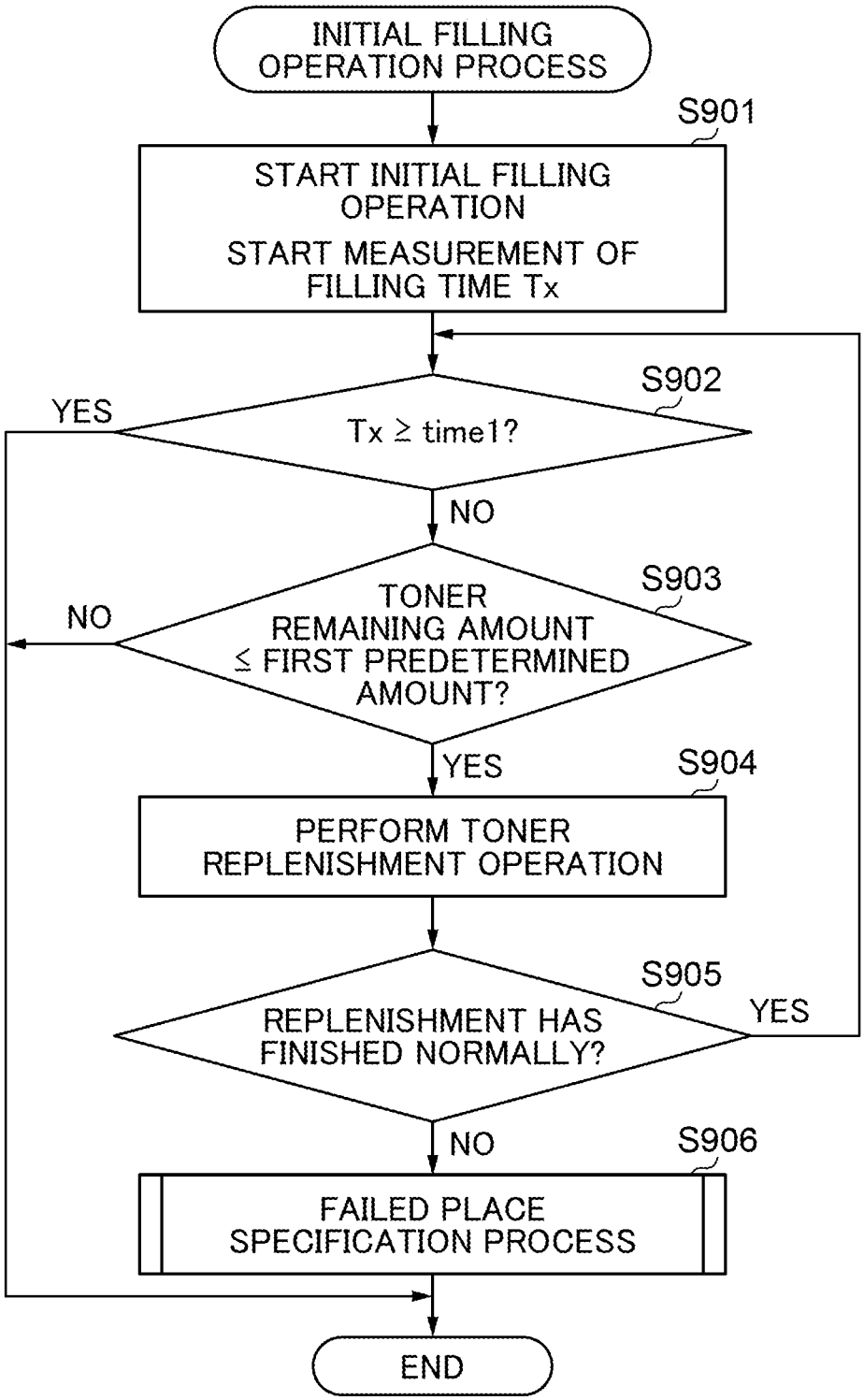
FIG. 9 is a flowchart showing an initial filling operation process in the image forming apparatus of FIG. 1.

FIG. 9 is a flowchart showing an initial filling operation process. This process is achieved when the CPU 212*a* develops a program stored in the ROM 212*b* to the RAM 212*c* and runs it. This process is started, when the image forming apparatus 10 is started for the first time or when the container 74 is replaced because the container 74 becomes empty. It should be noted that the CPU 212*a* corresponds to a determination means of the present invention in the processes in FIG. 8 and FIG. 9.

First, in step S901, the CPU 212*a* starts measurement of filling time Tx and starts an initial filling operation. In step S902, the CPU 212*a* determines whether the filling time Tx becomes equal to or more than the predetermined period time_1 (5 minutes). When Tx becomes equal to or more than time_1, the CPU 212*a* determines that there is abnormality in the filling operation and finishes the initial filling operation shown in FIG. 9. In the meantime, when Tx is less than time_1, the CPU 212*a* executes process in steps S903 through S906 that is similar to the process in the steps S803 through S806 in FIG. 8. Accordingly, when the toner remaining amount of the buffer container 20 does not exceed the first predetermined amount in the predetermined period time_1 after starting the initial filling operation, it is determined that there is abnormality in the filling operation.

When determining that the toner remaining amount of the buffer container 20 exceeds the first predetermined amount in the step S903, the CPU 212*a* finishes the initial filling operation process shown in FIG. 9. Moreover, when determining that the replenishment operation has finished normally in the step S905, the CPU 212*a* returns the process to the step S902. In the meantime, when determining that the replenishment operation has not finished normally, the CPU 212*a* determines that the replenishment operation abnormality has occurred. And then, the CPU 212*a* executes the failed place specification process (FIG. 10) mentioned later in the step S906 and finishes the initial filling operation process shown in FIG. 9.

Figure 10:
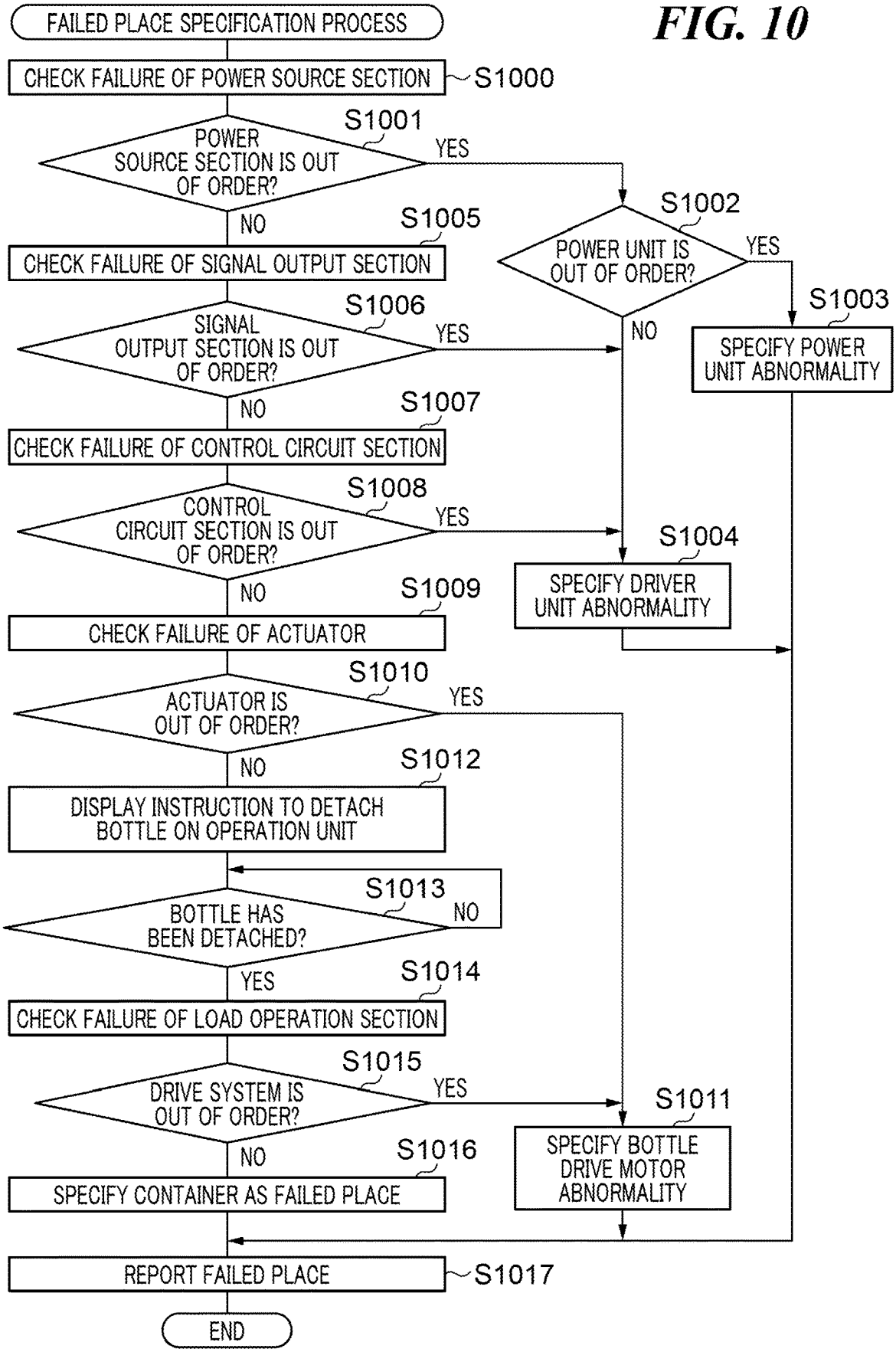
FIG. 10 is a flowchart showing a failed place specification process in the image forming apparatus of FIG. 1.

FIG. 10 is a flowchart showing the failed place specification process executed in the step S806 in FIG. 8 and the step S906 in FIG. 9. As mentioned above, this process is executed when it is determined that the replenishment operation abnormality has occurred. However, since a failed section of the control system is unknown specifically, the CPU 212*a* checks and determines a failed place for every section. Check and determination about each failed place will be described by also referring to FIG. 3 through FIG. 5.

First, the CPU 212*a* checks failure of the power source section in step S1000 and determines whether the power source section is out of order. Then, when the power source section is out of order, the CPU 212*a* proceeds with the process to step S1002. When the power source section is not out of order, the CPU 212*a* proceeds with the process to step S1005. In the step S1002, the CPU 212*a* determines whether the power unit 200 is out of order. When the power unit 200 is out of order, the CPU 212*a* proceeds with the process to step S1003. When the power unit 200 is not out of order, the CPU 212*a* proceeds with the process to step S1004.

Specifically, the CPU 212*a* checks failure of the power source section as follows in the steps S1000 through S1002. The CPU 212*a* checks the voltage of +24V_FU that passed the fuse FU3. In order to check the voltage of 24V_FU, the voltage detector 303*a* of the driver unit 230 detects whether the voltage of +24V before passing the fuse FU3 is equal to or more than a first threshold th1. In this embodiment, the first threshold th1 shall be 18V.

The detection result by the voltage detector 303*a* is transmitted to the CPU 212*a* through the ASIC 231. The CPU 212*a* checks a failed place according to the detection result of the voltage detector 303*a*. When the detection result shows that the voltage of +24V is less than the first threshold th1, the CPU 212*a* determines that the output of the power source section (the power unit 200) is abnormal, That is, the CPU 212*a* determines that the path (fuse FU2) that outputs the voltage of +24V of the power unit 200 is a failed place. In this case, the CPU 212*a* specifies the power unit 200 as a failed part (power output abnormality).

When the voltage of +24V is normal, the voltage detector 303*b* of the driver unit 230 detects whether the voltage of +24V_FU that passed the fuse FU3 is equal to or more than a second threshold th2. The second threshold th2 is equal to the first threshold th1, for example. The voltage detector 303*b* performs a detection process like the voltage detector 303*a* and transmits a detection result to the CPU 212*a* through the ASIC 231. The CPU 212*a* determines whether the voltage of +24V_FU is normal according to the detection result of the voltage detector 303*b*. That is, the CPU 212*a* determines that the voltage of +24V_FU is abnormal when the voltage of +24V_FU is less than the second threshold th2. When determining that the voltage of +24V_FU is abnormal, the CPU 212*a* determines that a failed place is the fuse FU3. In this case, the CPU 212*a* specifies the driver unit 230 as a failed part (what is called a fuse blown). When determining that both the voltages of +24V and +24V_FU are normal (the voltage of +24V is equal to or more than the first threshold th1 and the voltage of +24V is equal to or more than the second threshold th2), the CPU 212*a* determines that the power source section is normal.

The above description is summarized as follows. As a result of the determination in the step S1001, when the voltage of +24V is less than the first threshold th1 or the voltage of +24V is less than the second threshold th2, the CPU 212*a* proceeds with the process to the step S1002. When the voltage of +24V is equal to or more than the first threshold th1 and the voltage of +24V is equal to or more than the second threshold th2, the CPU 212*a* determines that the power source section is normal and proceeds with the process to the step S1005.

In the step S1002, the CPU 212*a* determines whether the power unit 200 (fuse FU2) is out of order. As a result of this determination, when the voltage +24V is less than the first threshold th1, the CPU 212*a* proceeds with the process to the step S1003 and specifies the power unit 200 as a failed (abnormal) place. As a result of the determination in the step S1002, when the voltage of +24V_FU is less than the second threshold th2, the CPU 212*a* proceeds with the process to the step S1004 and specifies the driver unit 230 as a failed (abnormal) place. After the step S1003 or S1004, the CPU 301 proceeds with the process to step S1017.

Next, the CPU 212*a* checks failure of the signal output section in the step S1005 and determines whether the signal output section is out of order in step S1006. Then, when the signal output section is out of order, the CPU 212*a* proceeds with the process to the step S1004. When the signal output section is not out of order, the CPU 212*a* proceeds with the process to step S1007.

Specifically, the CPU 212*a* checks failure of the signal output section as follows in the steps S1005 and S1006. In order to check a failed place in the signal output section, the CPU 212*a* checks the motor control signals transmitted to the motor driver 233 from the motor controller 234 of the ASIC 231. The motor control signals specify a rotational direction, speed, and driving mode of the bottle drive motor 72.

In order to check the motor control signals, the CPU 212*a* sets the ASIC 231 so that each motor control signal will be output at a High level. The signal detector 305 of the driver unit 230 compares the respective motor control signals with a third threshold th3. The third threshold th3 shall be 2.8V. The comparison results by the signal detector 305 are transmitted to the CPU 212*a* through the ASIC 231. The CPU 212*a* checks the output states according to the comparison results by the signal detector 305. When the comparison results show that all the motor control signals are equal to or more than the third threshold th3, the CPU 212*a* temporarily determines that the motor control signals are not abnormal. When the comparison results show that at least one motor control signal is less than the third threshold th3, the CPU 212*a* determines that the motor control signals are abnormal. When determining that the motor control signals are abnormal, the CPU 212*a* specifies the motor controller 234 as a failed place. In this case, the CPU 212*a* specifies the driver unit 230 as a failed part (signal output abnormality).

Next, the CPU 212*a* sets the ASIC 231 so that each motor control signal will be output at a Low level. The signal detector 305 checks the motor control signals by comparing the respective motor control signals with a fourth threshold th4. The fourth threshold th3 shall be 0.8V. The comparison results by the signal detector 305 are transmitted to the CPU 212*a* through the ASIC 231. The CPU 212*a* checks the output states according to the comparison results by the signal detector 305. When the comparison results show that all the motor control signals are less than the fourth threshold th4, the CPU 212*a* temporarily determines that the motor control signals are not abnormal. When the comparison results show that at least one motor control signal is equal to or more than the fourth threshold th4, the CPU 212*a* determines that the motor control signals are abnormal. When determining that the motor control signals are abnormal, the CPU 212*a* specifies the motor controller 234 as a failed place. In this case, the CPU 212*a* specifies the driver unit 230 as a failed part (signal output abnormality).

When temporarily determining that the motor control signals are not abnormal in both of a case where the motor control signals at the High level are output and a case where the motor control signals at the Low level are output, the CPU 212*a* t determines that the motor control signals are normal.

The above description is summarized as follows. As a result of the determination in the step S1006, when at least one motor control signal at the High level is less than the third threshold th3 or at least one motor control signal at the Low level is equal to or more than the fourth threshold th4, the CPU 212*a* determines that the motor control signals are abnormal. Accordingly, the CPU 212*a* specifies the motor controller 234 as a failed place and specifies the driver unit 230 as a failed (abnormal) part. In the meantime, when all the motor control signals at the High level are equal to or more than the third threshold th3 and all the motor control signals at the Low level are less than the fourth threshold th4, the CPU 212*a* determines that the motor control signals are normal and that the signal output section is not out of order. In this case, the CPU 212*a* proceeds with the process to the step S1007.

Next, the CPU 212*a* checks failure of the control circuit section in the step S1007 and determines whether the control circuit section is out of order in step S1008. Then, when the control circuit section is out of order, the CPU 212*a* proceeds with the process to the step S1004. When the control circuit section is not out of order, the CPU 212*a* checks failure of the bottle drive motor 72, which is an actuator, in step S1009. In step S1010, the CPU 212*a* determines whether the actuator is out of order. As a result of the determination, when the actuator is out of order, the CPU 212*a* proceeds with the process to step S1011. When the actuator is not out of order, the CPU 212*a* proceeds with the process to step S1012.

Specifically, the CPU 212*a* checks failure of the control circuit section and the actuator as follows in the steps S1007 through S1010. The CPU 212*a* checks the output of the motor driver 233 in order to check a failed place in the control circuit section. In order to check the output of the motor driver 233, the CPU 212*a* first sets the motor controller 234 of the ASIC 231 so as to drive the bottle drive motor 72. The ASIC 231 (the motor controller 234), which is the signal output section, transmits the motor control signals for driving the bottle drive motor 72 to the motor driver 233.

The current detector 306*a* of the driver unit 230 detects the output current from the control circuit section (the motor driver 233) in the state where the power supply voltage and the motor control signals are input into the control circuit section (the motor driver 233). In order to check presence of abnormality in the motor driver 233, the current detector 306*a* detects whether the electric current that flows into the bottle drive motor 72 from the motor driver 233 is equal to or more than a fifth threshold th5. The fifth threshold th5 shall be 100 mA.

The detection result by the current detector 306*a* is transmitted to the CPU 212*a* through the ASIC 231. The CPU 212*a* checks a failed place according to the detection result by the current detector 306*a*. When the detection result shows that the electric current that flows into the bottle drive motor 72 is equal to or more than the fifth threshold th5, the CPU 212*a* determines that the motor driver 233 is normal. When the detection result shows that the electric current that flows into the bottle drive motor 72 is less than the fifth threshold th5, the CPU 212*a* determines that the motor driver 233 is abnormal. When determining that the motor driver 233 is abnormal, the CPU 212*a* specifies the control circuit section as a failed place (control circuit abnormality).

In the meantime, when the detection result shows that the electric current that flows into the bottle drive motor 72 is less than the fifth threshold th5, failure of the actuator is also checked according to the operating state of the bottle drive motor 72. When the detection result shows that the electric current that flows into the bottle drive motor 72 is less than the fifth threshold th5 and when the bottle drive motor 72 is operating, the CPU 212*a* determines that a failed part is the driver unit 230. In the meantime, when the detection result shows that the electric current that flows into the bottle drive motor 72 is less than the fifth threshold th5 and when the bottle drive motor 72 is not operating, the CPU 212*a* determines that a failed place is the actuator (actuator abnormality). In this case, the CPU 212*a* specifies the bottle drive motor 72 as a failed part.

The above description is summarized as follows. When determining that the electric current is less than the fifth threshold th5 and that the bottle drive motor 72 is operating in the step S1008, the CPU 212*a* specifies the driver unit 230 (the motor driver 233) as a failed part in the step S1004. When determining that the electric current is equal to or more than the fifth threshold th5 or when determining that the electric current is less than the fifth threshold th5 and that the bottle drive motor 72 is not operating in the step S1008, the CPU 212*a* proceeds with the process to the step S1009. When determining that the electric current is less than the fifth threshold th5 and that the bottle drive motor 72 is not operating in the step S1010, the CPU 212*a* specifies the bottle drive motor 72 as a failed part. When determining that the electric current is equal to or more than the fifth threshold th5 in the step S1010, the CPU 212*a* determines that the motor driver 233 is normal and proceeds with the process to the step S1012. When the process proceeds to the step S1012, none of the power source section, signal output section, and control circuit section are determined as abnormal.

In such a state, it can be estimated that abnormality has occurred in the drive mechanism (the bottle drive motor 72 and drive gear) or a driven unit (the container 74). However, since an abnormal place cannot be distinguished between the drive mechanism and the driven unit, a failed place cannot be specified in detail. Accordingly, in the embodiment, the CPU 212*a* specifies a failed place in the load operation section after detaching the container 74 from the step S1012.

In the step S1012, the CPU 212*a* first displays the notification screen shown in FIG. 6 on the operation unit 1000. Accordingly, this notification screen is displayed on a condition that none of the power source section, signal output section, and control circuit section are determined as abnormal. The CPU 212*a* and the operation unit 1000 correspond to a notification means in the present invention. In this notification screen, a message that prompts a user to detach the container 74 attached and to shake it is displayed.

In the next step S1013, the CPU 212*a* refers to the detection result of the attachment sensor 71 and waits until the container 74 is detached. A user who looks at the notification screen displayed in the step S1012 detaches the container 74 and shakes it about 10 times according to the instructions displayed on the screen. When the container 74 is detached, the drive transfer between the bottle drive motor 72 and the container 74 is released. Then, the CPU 212*a* executes a failure check about the load operation section in step S1014 in response to detachment of the container 74. The CPU 212*a* determines that the container 74 is detached when the signal showing the detection result of the attachment sensor 71 varies to V from 3.3V. The CPU 212*a* operates the bottle drive motor 72 in the failure check about the load operation section. Since the drive transfer between the container 74 and the bottle drive motor 72 is intercepted, the CPU 212*a* is able to specify a failed place by detecting the load of the bottle drive motor 72.

That is, on the basis of the detection result by the current detector 306*a*, the CPU 212*a* determines whether the electric current that flows into the bottle drive motor 72, which is a load, is equal to or more than a sixth threshold th6. The sixth threshold th6 shall be 1.5 A. When the electric current that flows into the bottle drive motor 72 is equal to or more than the sixth threshold th6, the CPU 212*a* determines that the drive mechanism (the bottle drive motor 72 or the drive gear) is out of order. In this case, the CPU 212*a* specifies the bottle drive motor 72 (or the drive gear) as a failed place in the step S1011. In the meantime, when the electric current that flows into the bottle drive motor 72 is less than the sixth threshold th6 (is less than the predetermined value), the CPU 212*a* determines that the drive mechanism is not out of order and specifies the container 74 as a failed place in step S1016.

Prior to the process in the step S1012, the CPU 212*a* may execute a process of checking whether the rotation sensor 70 detects rotation (an operating state) of the container 74 for the check of the load operation section. In this case, the CPU 212*a* obtains the detection result of the rotation sensor 70 through the ASIC 231. When the rotation sensor 70 does not detect the rotation of the container 74, the CPU 212*a* determines that excessive torque, which occurs in the drive gear or the container 74 connected to the bottle drive motor 72, causes motor lock abnormality (operation abnormality). Subject to the determination of occurrence of the motor lock abnormality, the process may proceed to the step S1012. When the rotation sensor 70 detects the rotation of the container 74, the CPU 212*a* may determine that a failed place is unknown.

After the step S1011 or S1016, the CPU 212*a* proceeds with the process to the step S1017. In the step S1017, the CPU 212*a* reports the part that is specified as the failed place. For example, when the bottle drive motor 72 breaks down, the CPU 212*a* displays the message that instructs replacement of the bottle drive motor 72 as shown in FIG. 7A. Thereby, a service person is able to restore the image forming apparatus 10 from the failed state in a short time by replacing the reported part without investigating a failure cause. Accordingly, the downtime of the image forming apparatus 10 can be reduced.

Moreover, for example, when the container 74 breaks down, the CPU 212*a* displays the message that prompts replacement of the container 74 as shown in FIG. 7B. FIG. 7B is a mount screen that prompts a user to attach a container, which is different from the detached container 74, to the bottle mount TM. In addition, when a failed place is specified in the power source section, signal output section, or control circuit section, the CPU 212*a* displays a message that reports the specified failed place. The CPU 212*a* finishes the failed place specification process shown in FIG. 10 after executing the process in the step S1017. Particularly, a replacement method of the container 74 that a user is able to replace is clearly shown in FIG. 7B. Thereby, the user is able to restore the image forming apparatus 10 from the failed state in a short time by replacing the reported consumable without waiting for service of a service person. Accordingly, the downtime can be reduced more than the case where the bottle drive motor 72 breaks down.

The result of the failed place specification process may be reported to a call center through the network I/F 1001 in addition to the display on the operation unit 1000. When the failed part is reported to the call center through the network I/F 1001 at the time of occurrence of abnormality, a service person is able to know the failed part without going to the installation location of the image forming apparatus 10. Accordingly, the service person is able to prepare a substitute of the failed part beforehand at the time of the visit to the installation location, and is able to restore the image forming apparatus 10 from the abnormal state in a short time. It should be noted that the reporting method is not restricted to a display screen and the result may be reported by voice.

By performing the above failed place specification processes, a failed place can be specified also in a section that includes a drive mechanism and a driven unit.

After determining that the container 74 is out of order in the step S1015, the CPU 212*a* may perform the toner replenishment operation when the container 74 is attached again. At that time, when determining that the replenishment operation has not finished normally even though the replenishment operation has started, the CPU 212*a* may fix determination that the container 74 is out of order. In the meantime, when the replenishment operation has finished normally, the CPU 212*a* may cancel the determination that the container 74 is out of order. When employing such a configuration, the notification screen shown in FIG. 6 may be displayed after fixing the determination that the container 74 is out of order. Alternatively, when the notification screen shown in FIG. 6 is displayed before fixing the determination that the container 74 is out of order and then the determination is canceled, the CPU 212*a* may erase the notification screen shown in FIG. 6.

Although the power source section is checked first and then the signal output section is checked in FIG. 10, the order of the failure check may be inverted. This is because the inputs into the control circuit section from the power source section and the signal output section are performed in parallel.

According to the embodiment, the CPU 212*a* as a determination means determines whether the replenishment operation has finished normally (S805 and S905), when the toner replenishment operation has started (S804 and S904). When determining that the replenishment operation has not finished normally, the CPU 212*a* reports detaching the container 74 (S1012). When the detachment of the container 74 is detected after this report, the CPU 212*a* operates the bottle drive motor 72 and determines which of the bottle drive motor 72 or the container 74 is out of order. That is, the CPU 212*a* determines which of the bottle drive motor 72 or the container 74 is out of order on the basis of the load of the bottle drive motor 72 (the electric current that flows into the bottle drive motor 72) during the operation of the bottle drive motor 72. Thereby, when abnormality occurs in the replenishment operation, the CPU 212*a* is able to determine whether the bottle drive motor 72 is out of order. Moreover, thereby, when abnormality occurs in the replenishment operation, the CPU 212*a* is able to determine whether the container 74 is out of order.

According to the present invention, failure is analyzable in detail more than the conventional technique.

Although the present invention has been described in detail on the basis of the suitable embodiments, the present invention is not limited to these specific embodiments and includes various configurations that do not deviate from the scope of the present invention.

Other Embodiments

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2019-153937, filed Aug. 26, 2019, which is hereby incorporated by reference herein in its entirety.

What is claimed is:

1. An image forming apparatus comprising:

an image forming unit configured to form an image using developer;

a mount section on which a container containing the developer is mounted;

a drive mechanism that includes a motor that rotates the container mounted on the mount section to supply the developer to the image forming unit from the container mounted on the mount section;

a rotation sensor configured to detect a rotation of the container mounted on the mount section; and a processor configured to:

perform a supply operation in which the motor rotates the container mounted on the mount section;

determine an error of the supply operation based on a detection result of the rotation sensor;

obtain, in a case where the error is determined, an output value related to a load of the motor by driving the motor at a time when no container is mounted on the mount section after the container is detached from the mount section; and detect a failure of the container detached from the mount section based on a comparison of the output value to a predetermined value.

2. The image forming apparatus according to claim 1, further comprising a detector configured to output binary signals indicating whether or not a container is mounted on the mount section, and wherein, in a case where the error is determined, the processor obtains the output value after the binary signal changes from a first value indicating a state where a container is mounted on the mount section to a second value indicating a state where no container is mounted on the mount section.

3. The image forming apparatus according to claim 1, wherein the processor detects the failure of the container detached from the mount section in a case where the output value is less than the predetermined value.

4. The image forming apparatus according to claim 1, wherein the processor detects the failure of the container detached from the mount section in a case where the output value is less than the predetermined value, detects a failure of the drive mechanism in a case where the output value is not less than the predetermined value.

5. The image forming apparatus according to claim 1, further comprising a display configured to display a screen that prompt detachment of the container, wherein, in a case where the error is determined, the processor obtains the output value after the screen is displayed on the display.

6. The image forming apparatus according to claim 1, further comprising a display configured to display a replacement screen that prompts replacement of the container of which the failure is detected.

7. An image forming apparatus comprising:

an image forming unit configured to form an image using developer;

a mount section on which a container containing the developer is mounted;

a drive mechanism that includes a motor that rotates the container mounted on the mount section to supply the developer to the image forming unit from the container mounted on the mount section;

a rotation sensor configured to detect a rotation of the container mounted on the mount section; and a processor configured to:

perform a supply operation in which the motor rotates the container mounted on the mount section;

determine an error of the supply operation based on a detection result of the rotation sensor;

obtain, in a case where the error is determined, an output value related to a load of the motor by driving the motor at a time when no container is mounted on the mount section; and detect a failure of the drive mechanism based on a comparison of the output value to a predetermined value.

8. The image forming apparatus according to claim 7, wherein the processor detects the failure of the drive mechanism in a case where the output value is more than the predetermined value.

9. The image forming apparatus according to claim 7, wherein the processor detects the failure of the drive mechanism in a case where the output value is more than the predetermined value, detects a failure the container detached from the mount section in a case where the output value is less than the predetermined value.

10. The image forming apparatus according to claim 7, further comprising a detector configured to output binary signals indicating whether or not a container is mounted on the mount section, and wherein, in a case where the error is determined, the processor obtains the output value after the binary signal changes from a first value indicating a state where a container is mounted on the mount section to a second value indicating a state where no container is mounted on the mount section.

11. The image forming apparatus according to claim 7, further comprising a display configured to display a screen that prompts detachment of the container, wherein the processor obtains the output value after the screen is displayed on the display.

12. The image forming apparatus according to claim 7, further comprising a display configured to display a notification screen that reports the failure of the drive mechanism.

13. The image forming apparatus according to claim 7, further comprising a display configured to display a replacement screen that prompts replacement of the drive mechanism.

* * * * *